United States Patent [19]

Kasahara et al.

[11] Patent Number: 4,954,798

[45] Date of Patent: Sep. 4, 1990

[54] DEVICE FOR COUPLING REVERSIBLE ELECTROMAGNETIC CONTACTORS TO EACH OTHER WITH AN INTERLOCK UNIT

[75] Inventors: Mitsuharu Kasahara; Kuniyuki Kogawa; Takato Hirota, all of Kanagawa, Japan

[73] Assignee: Fuji Electric Co., Ltd., Kanagawa, Japan

[21] Appl. No.: 233,528

[22] Filed: Aug. 18, 1988

[30] Foreign Application Priority Data

Aug. 19, 1987 [JP] Japan ..... 62-126044[U]
Aug. 19, 1987 [JP] Japan ..... 62-126045[U]

[51] Int. Cl.[5] ..... H01H 9/20

[52] U.S. Cl. ..... 335/161; 200/50 C; 439/716

[58] Field of Search ..... 335/160, 161, 159; 200/50 C, 307; 361/376, 353, 363, 331, 393, 394; 439/532, 716, 717

[56] References Cited

U.S. PATENT DOCUMENTS 3,302,160 1/1967 Nielsen ..... 439/716
4,611,879 9/1986 Bullard ..... 439/717

FOREIGN PATENT DOCUMENTS 2651589 5/1978 Fed. Rep. of Germany ..... 439/716
54-10455 5/1979 Japan .
57-11311 3/1982 Japan .
344463 3/1960 Switzerland ..... 439/717

*Primary Examiner*—H. Broome
*Attorney, Agent, or Firm*—Finnegan, Henderson, Farabow, Garrett, and Dunner

[57] ABSTRACT

An electromagnetic contactor coupling device, in which electromagnetic contactors are put side by side with an interlock unit sandwiched therebetween for preventing the electromagnetic contactors from simultaneously turning on, and are integrally coupled to each other by a coupler. The device is arranged to have abutment portions wider at its rear end than at its front end so that, in order to prevent displacement of the interlock unit due to vibrations or the like, force for sandwiching the interlock unit is exerted on the interlock unit as the coupler is inserted between the electromagnetic contactors.

6 Claims, 4 Drawing Sheets

DEVICE FOR COUPLING REVERSIBLE ELECTROMAGNETIC CONTACTORS TO EACH OTHER WITH AN INTERLOCK UNIT

BACKGROUND OF THE INVENTION

1. Field of the Invention

The present invention relates to a device for coupling two electromagnetic contactors to each other in a reversible electromagnetic contactor insertable in a reversible control circuit of an electric motor or the like and arranged to operate so that only one of the electromagnetic contactors is turned on even when an input signal is simultaneously applied to both of the electromagnetic contactors.

2. Related Art

FIG. 1 shows an example of a conventional reversible electromagnetic contactor provided with a mechanical interlock unit that prevents two electromagnetic contactors from turning on at the same time even if an input signal is simultaneously applied to the two electromagnetic contactors. In FIG. 1, reference numerals 1 and 2 designate electromagnetic contactors. The electromagnetic contactors 1 and 2 are integrally coupled to each other by means of a coupler 4 with a mechanical interlock unit 3 interposed between the contactors 1 and 2. The mechanical interlock unit 3 is arranged to prevent the two electromagnetic contactors 1 and 2 from turning on at the same time even when an input signal is simultaneously applied to the two electromagnetic contactors 1 and 2. Such a mechanical interlock unit has been well known as shown by Japanese Utility Model Post-Examination Publication No. 11311 (entitled "Mechanical Locking Device for Electromagnetic Contactors").

FIG. 2 is a perspective view showing a lower half portion of the reversible electromognetic contactor of FIG. 1 viewed from the bottom side thereof. In FIG. 2, the electromagnetic contactors 1 and 2 are attached so as to be mounted on a U-shaped support rail (not shown). Rail hanging portions 1*a* and 2*a*, and sliders 1*b* and 2*b* are provided on the bottoms of the electromagnetic contactors 1 and 2 respectively. The sliders 1*b* and 2*b* have been well known as shown, for example, by Japanese Utility Model Post-Examination Publication No. 54-10455 (entitled "Device for Attaching Electric Appliance onto Rail"), and are made slidable vertically in the drawing.

The electromagnetic contactors 1 and 2 are attached to the support rail in such a manner that the rail hanging portions 1*a* and 2*a* are hung at one end of the U-shaped support rail, and then the sliders 1*b* and 2*b* are pressed against the other end of the support rail so that the sliders 1*b* and 2*b* move downward in the drawing. If the respective top ends of the sliders 1*b* and 2*b* have gotten over the support rail, the sliders 1*b* and 2*b* return to the positions shown in the drawing so that the support rail is grasped between the rail hanging portions 1*a* and 2*a* and the sliders 1*b* and 2*b*. The support rail is adapted to be attached to recess portions 1*c* and 2*c*.

Two engagement grooves 1*f* are formed in each of the opposite side surfaces of the electromagnetic contactor 1 and two engagement grooves 2*f* are formed in each of the opposite side surfaces of the electromagnetic contactor 2. A coupler 4 (FIG. 3) having two engagement portions 4*a* formed on each of its opposite side surfaces corresponding to the engagement grooves 1*f* and 2*f* is inserted between the electromagnetic contactors 1 and 2 to couple the electromagnetic contactors 1 and 2 to each other. Because the interlock unit 3 is sandwiched between the electromagnetic contactors 1 and 2, the coupler 4 is inserted from the bottom side of the electromagnetic contactors 1 and 2.

However, the coupling described above has problems because no particular force for sandwiching the interlock unit 3 is exerted between the electromagnetic contactors 1 and 2. Therefore, the engagement portions of the interlock unit 3 with the electromagnetic contactor 1 and 2 may be abraded owing to vibrations during operation of the electromagnetic contactors, or when the electromagnetic contactors 1 and 2 are simultaneously turned on, a force may be exerted on the interlock unit 3 so that the electromagnetic contactors 1 and 2 escape outward as shown by an arrow in FIG. 1 to change the relative position between the intelock unit 3 and the electromagnetic contactors 1 and 2, and lower the interlocking function.

Further, in the case where the two electromagnetic contactors 1 and 2 are different in height from each other, if the coupler 4 is pressed into place between the electromagnetic contactors 1 and 2 while the upper surfaces of the respective electromagnetic contactors 1 and 2 are fixed so as to agree with a work surface 15 as shown in FIG. 4, a step difference is produced between the electromagnetic contactors 1 and 2 as shown in the drawings so that the positions of the rail fitting recess portions 1*c* and 2*c* are uneven with respect to each other.

The problem of such a step difference may be solved by partially inserting the coupler 4 between the electromagnetic contactors 1 and 2 so as to be fixed therebetween provisionally when the electromagnetic contactors 1 and 2 are in a laid down condition. The electromagnetic contactors 1 and 2 are then raised so as to make the coupler 4 abut on the work surface 15 as shown in FIG. 5. Then the electromagnetic contactors 1 and 2 are pressed down so that the bottom surface 1*d* and 2*d* of the respective electromagnetic contactors 1 and 2 abut on the work surface 15. Thus, the rail-fitting recess portions 1*c* and 2*c* of the respective electromagnetic contactors 1 and 2 become even with each other as shown in FIG. 6. In this condition, however, the rail fitting recess portions 1*c* and 2*c* are closed or blocked by the coupler 4. To solve this blockage problem, the coupler 4 may be pushed into place between the electromagnetic contactors 1 and 2. However, if the electromagnetic contactors 1 and 2 are turned upside down in order to insert the coupler 4, the problem as shown in FIG. 4 occurs because the electromagnetic contactors 1 and 2 differ in height from each other.

SUMMARY OF THE INVENTION

Accordingly, a first object of the present invention is to provide a device for coupling electromagnetic contactors in which force for sandwiching an interlock unit is generated between the electromagnetic contactors in coupling the electromagnetic contactors so that difficulties such as abrasion in the engagement portion of the interlock unit, deterioration in interlocking function, etc., are prevented.

Another object of the present invention is a device for coupling electromagnetic contactors which facilitates inserting a coupler so that a reversible electromagnetic contactor can be easily assembled.

The above and other objects can be achieved by an electromagnetic contactor coupling device in which a coupler having engagement portions on opposite side surfaces thereof is inserted from bottom sides of the electromagnetic contactors into a position between the electromagnetic contactors having engagement grooves formed in side surfaces thereof so that the two electromagnetic contactors are integrally coupled to each other with an interlock unit sandwiched therebetween, the width of the coupler at a portion thereof abutting on the side surface of each of the electromagnetic contactors is made larger at the rear end than at the front end thereof. In the electromagnetic contactor coupling device according to the present invention, since the coupler is wider at the rear end than at the front end, the space between the electromagnetic contactors is narrower at the upper portion due to a wedging action as the coupler is inserted so that a sandwiching force is exerted on the interlock unit.

The coupler is also provided with legs at front and rear portions of a bottom surface thereof, the interval between the legs being selected to be not smaller than the width of a support rail on which the electromagnetic contactors are attached. The length of the legs is selected so as not to be shorter than a step difference from the bottom surface of the rail abutting on each of the electromagnetic contactors.

In the electromagnetic contactor coupling device according to the present invention, even if the electromagnetic contactors are pressed on the coupler when it is put on the work surface, a rail housing space can be secured in the bottom surface of the coupler because of the function of the leg portions extending from the bottom surface of the coupler.

Additional objects and advantages of the present invention may be realized and obtained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the invention and, together with the description, serve to explain the principles of the invention.

DESCRIPTION OF THE PREFERRED EMBODIMENTS

Figure 1:
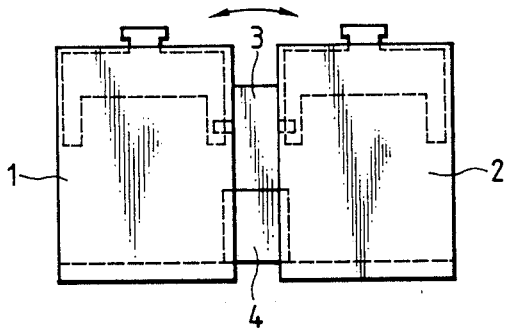
FIG. 1 PRIOR ART
FIG. 1 is a front view of a reversible electromagnetic contactor using a conventional device.
Figure 3:
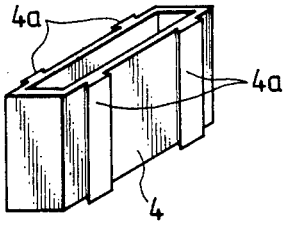
FIG. 3 PRIOR ART
FIG. 3 is a perspective view of a coupler of FIG. 2.
Figure 2:
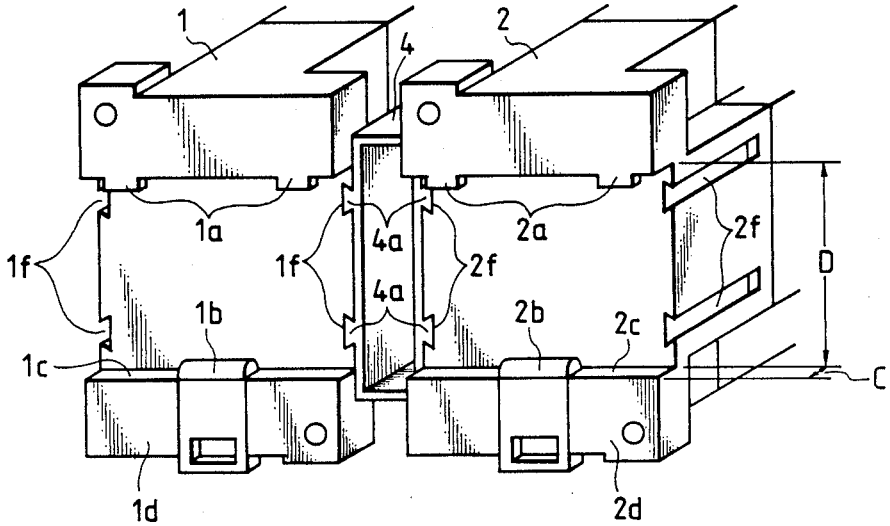
FIG. 2 PRIOR ART
FIG. 2 is a perspective view showing in detail a lower half of the arrangement of FIG. 1 from a back side thereof.
Figure 4:
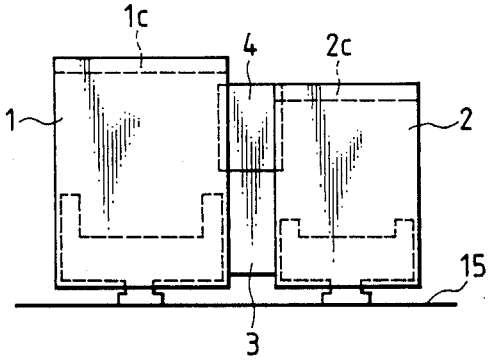
FIG. 4 PRIOR ART
FIGS. 4 through 6 are front views for explaining the work of inserting the coupler into position between electromagnetic contactors.
Figure 5:
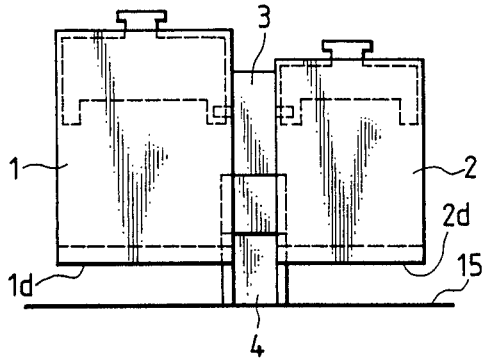
FIG. 5 PRIOR ART
Figure 6:
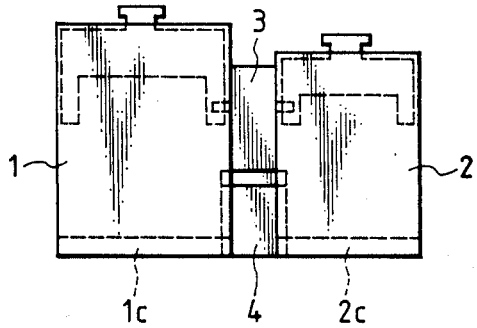
FIG. 6 PRIOR ART
Figure 7:
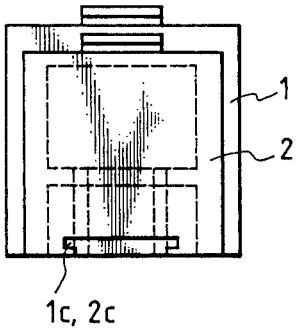
FIG. 7 PRIOR ART
FIG. 7 is a side view of FIG. 6.

Referring to the drawings, embodiments of the present invention will be described. In FIGS. 8 through 11 showing embodiments of the invention, the same parts as those in FIGS. 1 through 7 are correspondingly referenced, and the description of them will be omitted.

Figure 8:
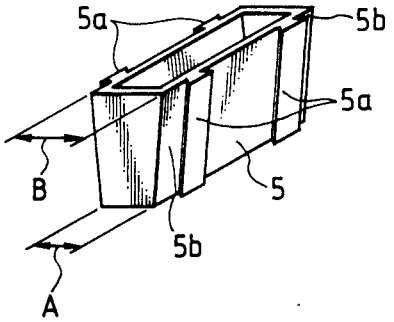
FIGS. 8, 9, and 11 are perspective views respectively showing various embodiments of the coupler of the present invention.
Figure 9:
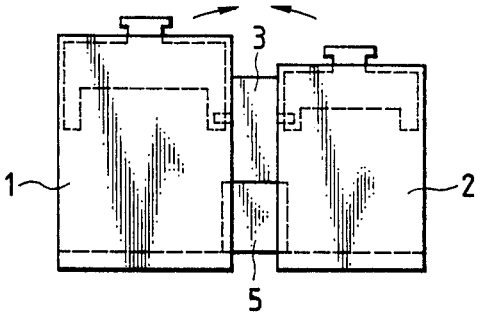

FIG. 8 shows an embodiment of the present invention. In the drawing, a coupler 5 is gradually changed in width from its front end (the lower end portion in FIG. 8) toward its rear end so that the width A at the front end is narrower than the width B at the rear end. The coupler 5 is inserted from its narrow front end into position between the electromagnetic contactors 1 and 2, while engagement portions 5*a* formed on the opposite sides of the coupler 5 are engaged with the engagemment grooves 1*f* and 2*f* of the electromagnetic contactors 1 and 2, so that the electromagnetic contactors 1 and 2 are coupled to each other through the coupler 5 as shown in FIG. 9. At that time (that is, when the electromagnetic contactors 1 and 2 are coupled to each other), the side surfaces 5*b* of the coupler 5 abut on the respective side surfaces of the electromagnetic contactors 1 and 2, and the contact pressure therebetween increases toward the rear end of the coupler 5.

Thus, the width of the coupler 5 at its portion abutting on the side surfaces of the electromagnetic contactors 1 and 2 is narrower at the front end side of the coupler 5 than at the rear end side of the same, so that the interval between the electromagnetic contactors 1 and 2 is narrower on the upper side thereof. Accordingly, a sandwiching force is exerted onto the interlock unit 3 in the direction shown by arrows in FIG. 9.

Figure 10:
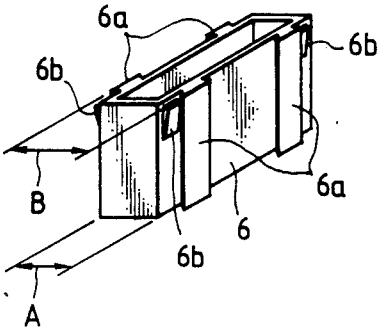
FIG. 10 is a schematic front view of the reversible electromagnetic contactor of the present invention for explaining the operation of the embodiment of the present invention.

FIG. 10 shows another embodiment, in which partially wedge-like protrusions 6*b* are provided on the outside of each pair of engagement portions 6*a* on each of opposite side surfaces of a coupler 6 at its rear end side, so that the width B at the rear end of the coupler 6 is wider than the width A at the front end of the same. When the coupler 6 is inserted into position between the electromagnetic contactors 1 and 2, the protrusions 6*b* abut onto the side surfaces of the electromagnetic contactors 1 and 2 at the rear end side of the coupler 6.

Figure 11:
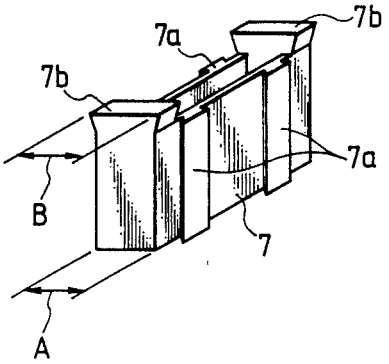

FIG. 11 shows a further embodiment, in which extended portions 7*b*, each having a gradually widened width, are provided on the opposite sides of a coupler 7 at its rear end side except a portion for a support rail, so that the width B at the rear end of the coupler 7 is wider than the width A at the front end of the same. Engagement portions 7*a* and 7*a* engage the engagement grooves 1*f* and 2*f*, respectively. In this case, the area abutting on the electromagnetic contactors 1 and 2 is increased, so that the coupling force is increased.

FIGS. 12 through 15 show an embodiment in which two electromagnetic contactors are different in height from each other. In the drawings, the same parts as those in FIGS. 1 through 7 are correspondingly referenced, and the description of them will be omitted.

Figure 12:
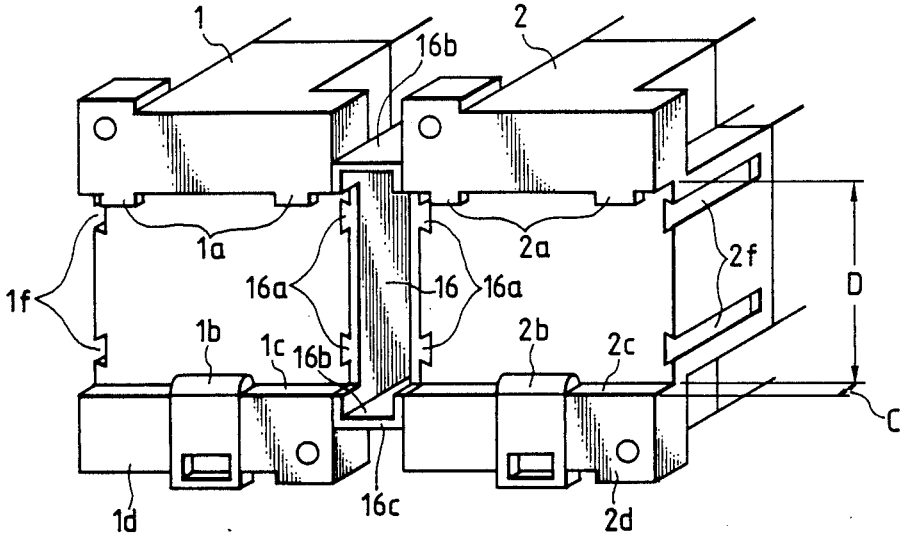
FIG. 12 is a perspective view showing in detail a lower half of the reversible electromagnetic contactor according to the present invention from its back side, the reversible contactor having two electromagnetic contactors different in height from each other.
Figure 13:
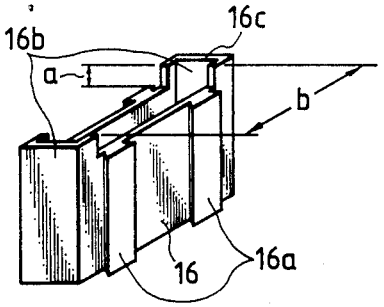
FIG. 13 is a perspective view of the coupler of FIG. 12.

In FIGS. 12 and 13, legs 16*b* even in length are provided on opposite ends of a bottom surface of a coupler 16 which has engagement portions 16*a* on its side surfaces. The length a of the legs 16*b* is a little larger than a step difference C of each of the rail-fitting recess portions 1c and 2c in FIG. 12, and the interval b between the legs 16b and 16b is a little larger than the width of each of the recess portions 1c and 2c, that is, the width D of a rail (not shown).

Figure 15:
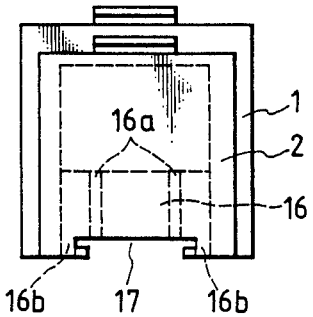
FIG. 15 is a side view of FIG. 14.

When coupler 16 is inserted into position between the electromagnetic contactors 1 and 2 so that an end surface 16c of each of the legs 16b is fitted between the bottom surfaces 1d and 2d of the electromagnetic contactors 1 and 2 as shown in FIG. 12, a rail housing space 17 is secured between the rail fitting portions 1c and 2c (FIG. 15).

Figure 14:
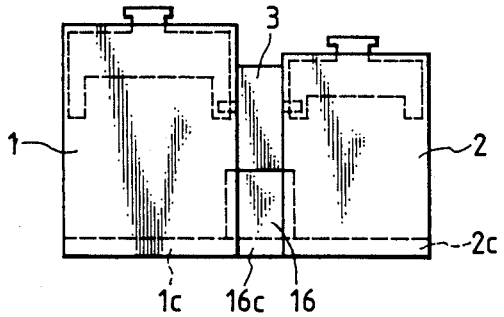
FIG. 14 is a front view of the reversible electromagnetic contactor of FIG. 12.

Accordingly, a reversible electromagnetic contactor having electromagnetic contactors 1 and 2 different in height from each other as shown in FIGS. 14 and 15 can be easily formed without closing the rail housing space only by pressing the electromagnetic contactors 1 and 2 by hand toward the work surface 15 while the coupler 16 abuts against the work surface 15 in the condition that the coupler 16 is provisionally fitted in between the electromagnet contactors 1 and 2.

According to the present invention, since the width of the coupler is larger at the rear end than at the front end thereof, a sandwiching force is exerted onto the interlock unit from the electromagnetic contactors as the coupler is inserted into position between the electromagnetic contactors, so that abrasion of the engagement portion of the interlock unit an deterioration of the interlocking function of the interlock unit can be prevented.

Further, even in the case of electromagnetic contactors different in height from each other, the reversible electromagnetic contactor can be easily assembled without causing any displacement, because the coupler is provided with legs at front and rear portions of a bottom surface thereof, the length of the legs being selected to be not shorter than a step difference from the bottom surface to the rail abutting surface of each of the electromagnetic contactors, the interval between the legs being selected to be not smaller than the width of a support rail on which the electromagnetic contactors are attached.

It will be apparent to those skilled in the art that various modifications and variations may be made to the above-described embodiments without departing from the scope of the appended claims and their equivalents.

What is claimed is:

1. A device comprising:

an interlock unit;

first and second electromagnetic contactors, each electromagnetic contactor having a bottom side, a coupler side surface, and engagement grooves formed in the coupler side surface; and a coupler integrally coupling said electromagnetic contactors to each other with the interlock unit sandwiched therebetween, the coupler having a front end, a rear end, a varying width, and first and second opposite side surfaces each having engagement portions inserted into the engagement grooves from the bottom sides of said electromagnetic contactors, wherein the width of said coupler at a portion thereof abutting on the coupler side surface of each of said electromagnetic contactors is larger at the rear end than at the front end thereof.

2. A device according to claim 1, further including wedge elements secured to said side surfaces of said coupler proximate said rear end thereof to cause said rear end of said coupler to be wider than said front end thereof.

3. A device according to claim 1, further including an extended portion projecting from the rear end of said coupler and having a width greater than the width of said front end of said coupler.

4. A device comprising:

an interlock unit;

first and second electromagnetic contactors, each contactor having a bottom surface, a coupler abutting surface, a rail abutting surface, and engagement grooves formed in the coupler abutting surface, wherein the electromagnetic contactors are adapted to be attached to a support rail having a width; and a coupler integrally coupling said first and second electromagnetic contactors to each other with the interlock unit sandwiched therebetween, the coupler having a main body portion, engagement portions inserted in the engagement grooves, a bottom surface including front and rear portions, and legs at the front and rear portions spaced apart by a selected interval, the interval between said legs being at least as large as the width of the support rail, said legs extending from the bottom surface and away from the main body portion and having a length at least as large as a step difference from the bottom surface to the rail abutting surface of each of said electromagnetic contactors.

5. The device of claim 1, wherein the first and second electromagnetic contactors are reversible and wherein the interlock unit is mechanically coupled to the first and second electromagnetic contactors for preventing the first and second electromagnetic contactors from turning on at the same time.

6. The device of claim 4, wherein the first and second electromagnetic contactors are reversible and wherein the interlock unit is mechanically coupled to the first and second electromagnetic contactors for preventing the first and second electromagnetic contactors from turning on at the same time.

* * * * *